US010750777B2

(12) United States Patent
Katz

(10) Patent No.: US 10,750,777 B2
(45) Date of Patent: Aug. 25, 2020

(54) DISPOSABLE PIPE

(71) Applicant: Martin D. Katz, Princeton Junction, NJ (US)

(72) Inventor: Martin D. Katz, Princeton Junction, NJ (US)

( * ) Notice: Subject to any disclaimer, the term of this patent is extended or adjusted under 35 U.S.C. 154(b) by 197 days.

(21) Appl. No.: 15/054,880

(22) Filed: Feb. 26, 2016

(65) Prior Publication Data

US 2016/0249678 A1 Sep. 1, 2016

Related U.S. Application Data

(60) Provisional application No. 62/121,002, filed on Feb. 26, 2015.

(51) Int. Cl.

| | |
|---|---|
| ***A24F 1/32*** | (2006.01) |
| ***A24F 1/00*** | (2006.01) |
| ***A24F 5/00*** | (2006.01) |

(52) U.S. Cl.

CPC ..... *A24F 1/32* (2013.01); *A24F 1/00* (2013.01); *A24F 5/00* (2013.01)

(58) Field of Classification Search

CPC ..... A24F 1/32; A24F 1/00; A24F 5/00; A24F 5/02; A24F 1/28

USPC ..... 206/244, 271, 273; D27/163, 167, 180

See application file for complete search history.

(56) References Cited

U.S. PATENT DOCUMENTS

| | | | | |
|---|---|---|---|---|
| 3,902,505 | A | 9/1975 | Carleton | |
| 4,058,130 | A | 11/1977 | Curtiss | |
| 4,286,607 | A | 9/1981 | Claessens | |
| 2003/0178035 | A1 | 9/2003 | Miller | |
| 2008/0047570 | A1* | 2/2008 | Plank | A24F 1/28 131/191 |
| 2011/0240047 | A1* | 10/2011 | Adamic | A24F 1/00 131/328 |
| 2013/0133672 | A1 | 5/2013 | Walsh | |
| 2013/0175197 | A1* | 7/2013 | Fieldman | B65D 85/00 206/541 |
| 2016/0183589 | A1* | 6/2016 | Born | A24F 1/28 131/191 |
| 2018/0271145 | A1* | 9/2018 | Cappelucci | A24F 1/32 |

OTHER PUBLICATIONS

TheJailMail, Screenshots from "How to Make a Bong from a Toilet Roll Prison Style", Published Aug. 20, 2013 (Year: 2013).*

(Continued)

*Primary Examiner* — Michael H. Wilson

*Assistant Examiner* — Sonny V Nguyen

(74) *Attorney, Agent, or Firm* — Robert M. Schwartz; Alfred K. Dassler

(57) ABSTRACT

A foldable disposable smoking pipe having a bowl and elongated body that is formed from a substrate blank having a laminated layer of foil and an adhesive strip, so that the pipe is easily constructed from the substrate blank into an elongated body walled portion having a trapezoidal cross section and a bowl constructed from the substrate blank into a shape of a frustum, where the bowl is inserted into an opening in the walled body portion and an adhesive holds the bowl in place on the body portion and the smoking pipe can be used for a limited number of times until it degrades due to the heat generated from a burning substance.

13 Claims, 12 Drawing Sheets

(56) References Cited

OTHER PUBLICATIONS

Fold ABol, "Fold a Bol . . . This Card Means Business", published Feb. 21, 2015, Youtube (Year: 2015).*
https://www.youtube.com/watch?v=Fub77ajWQf8 "How to Make a Bong From a Toilet Roll Prison Style".
http://www.puffnpitch.com/folding-instructions/.

* cited by examiner

DISPOSABLE PIPE

CROSS-REFERENCE TO RELATED APPLICATIONS

This application claims the benefit of U.S. Provisional Patent Application Ser. No. 62/121,002, filed on Feb. 26, 2015, entitled Disposable Pipe, this prior application is herewith incorporated by reference in the entirety.

BACKGROUND OF THE INVENTION

The invention relates to disposable smoking pipes used to smoke tobacco or other substances that are burned in a pipe bowl, more specifically, the smoking pipe is foldable from a compact state, and is assembled for use and is designed to be primarily disposable after one or more uses.

DESCRIPTION OF THE RELATED ART

Portable disposable smoking pipes are known such as U.S. Pat. No. 3,902,505 that was issued Sep. 2, 1975 to Carleton, which discloses a foldable flat blank, but with a bowl that requires insertion of a finger, or other object, into the foil portion of the bowl to expand the bowl into the hollow stem of the pipe. The bowl requiring perforations so that air can be drawn through the bowl to the open end. The present invention has a bowl that does not require insertion of an object to form the bowl nor perforations in the foil of the bowl and thus is much easier to assemble and use.

SUMMARY OF THE INVENTION

It is accordingly an object of the invention to provide a portable smoking pipe that overcomes the above-mentioned disadvantages of the heretofore-known devices and methods of this general type and which provides a disposable smoking pipe that is easy to assemble and to use.

With the foregoing and other objects in view there is provided, a smoking pipe having a tube having a longitudinal channel extending between a first open end and a second open end opposite said first open end, the tube being formed by a substrate material, the tube having a tube wall opening formed therein adjacent the first open end, the tube wall opening having at least one flap extending around an edge of the opening, the at least one flap being directed into the longitudinal channel, a bowl formed of the substrate material, the bowl having an outer surface, an inner surface, a loading opening and a suction side opening, the bowl being disposed in the tube wall opening with the outer surface engaging the at least one flap for positioning the bowl in the tube wall opening with the suction opening disposed centrally with respect to a height of the longitudinal channel.

In accordance with another feature of the invention, the adhesive layer adheres the outer surface to the at least one flap In accordance with an added feature of the invention the bowl is in the shape of a frustum.

With the objects of the invention in view, there is also provided the inner surface has a heat resistant foil laminated thereon.

In accordance with yet a further feature of the invention, the substrate material of the tube is scored around an edge of the tube wall opening for defining the at least one flap.

In accordance with another added feature of the invention the bowl has panels defined by folds in the substrate material.

With the foregoing and other objects in view the first end has a carb opening.

In accordance with another feature of the invention, there is a substrate blank for forming a smoking pipe, the blank having a first body portion having score lines for folding the body portion into a tube, the first body portion having a footprint equal to or less than a standard size of a credit card, a second body portion affixed to a peripheral edge on the first body portion, the second body portion having bowl score lines for folding the second body portion into a bowl, the second body portion being foldable onto the first body portion for placing the second body portion within the footprint.

In accordance with yet a further feature of the invention, the peripheral edge has a score at the second body portion to fold the second body portion onto the first body portion and to remove the second body portion from the first body portion.

In accordance with yet another feature of the invention, the first body portion has an opening formed therein and an opening forming pattern that includes cut lines and score lines, that define displaceable flaps, which when displaced define a second opening, the opening forming pattern disposed to align the second opening with the first opening when the first body portion is folded into the tube.

In accordance with another feature of the invention, the bowl score lines are radial score lines that define bowl panels, a first bowl panel of bowl panels overlapping at least one further bowl panel of bowl panel when the second body portion is folded into the panel.

In accordance with another feature of the invention, the second body portion has a heat resistant foil laminated thereon.

In accordance with yet another feature of the invention, the score lines are longitudinal score lines that define tube panels, a first tube panel of the tube panels overlap at least one further tube panel of the tube panels when the first body portion is folded into the tube.

DESCRIPTION OF THE PREFERRED EMBODIMENTS

Figure 1:
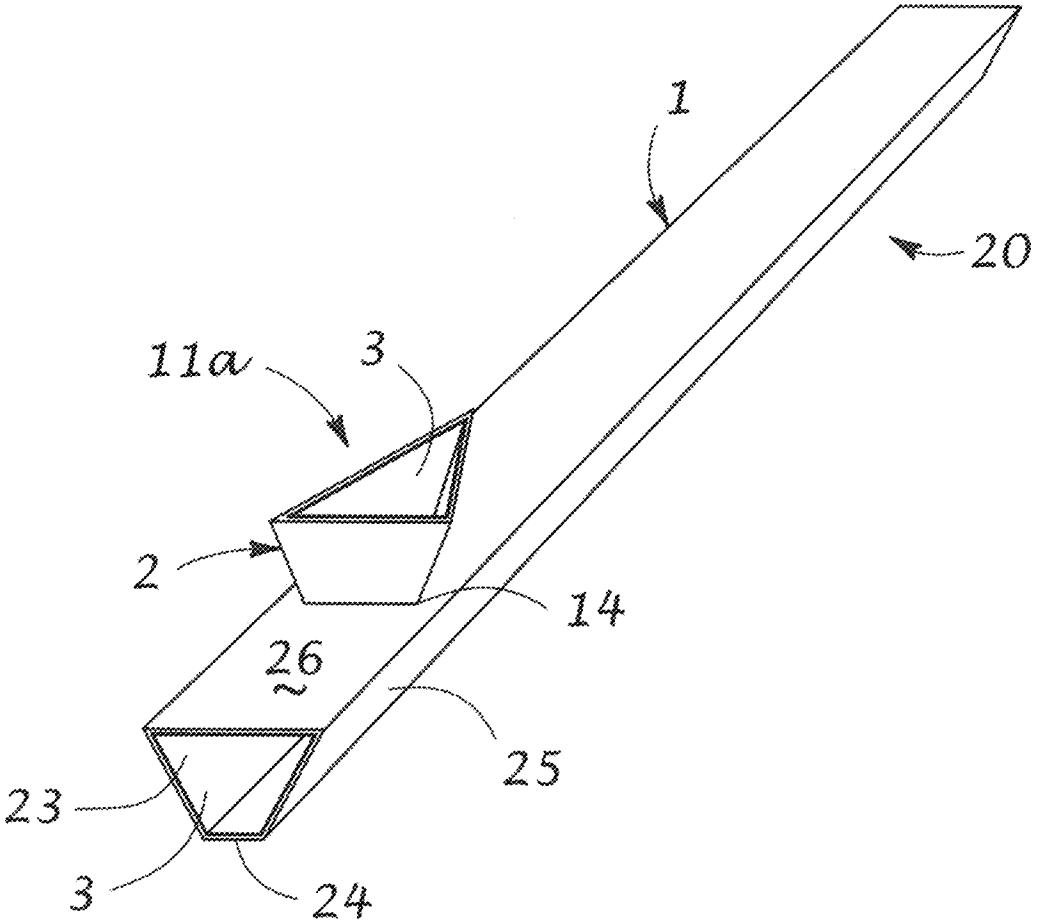
FIG. 1 is a perspective view of the assembled disposable smoking pipe of the present invention.
Figure 2:
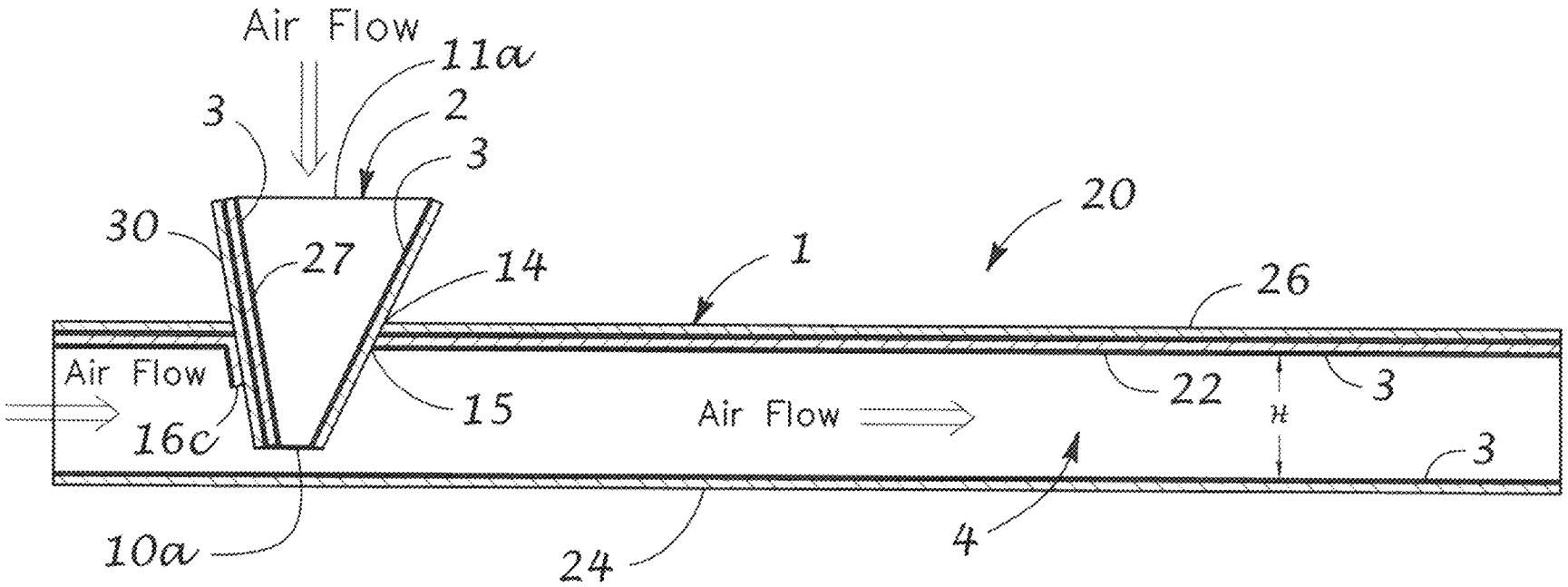
FIG. 2 is a sectional view of the pipe taken along lines B-B of FIG. 3.
Figure 3:
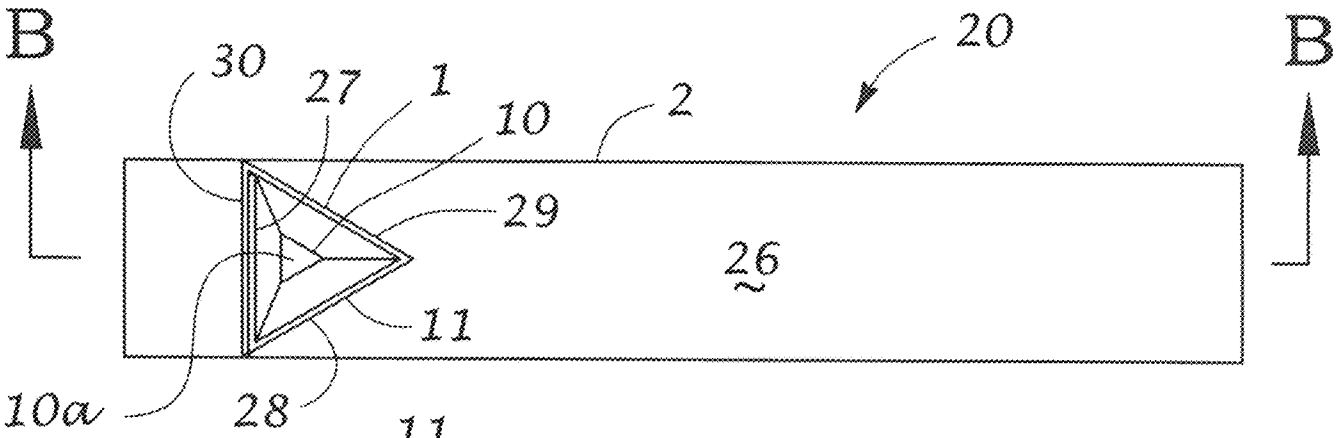
FIG. 3 is a top plan view of the assembled pipe.
Figure 4A:
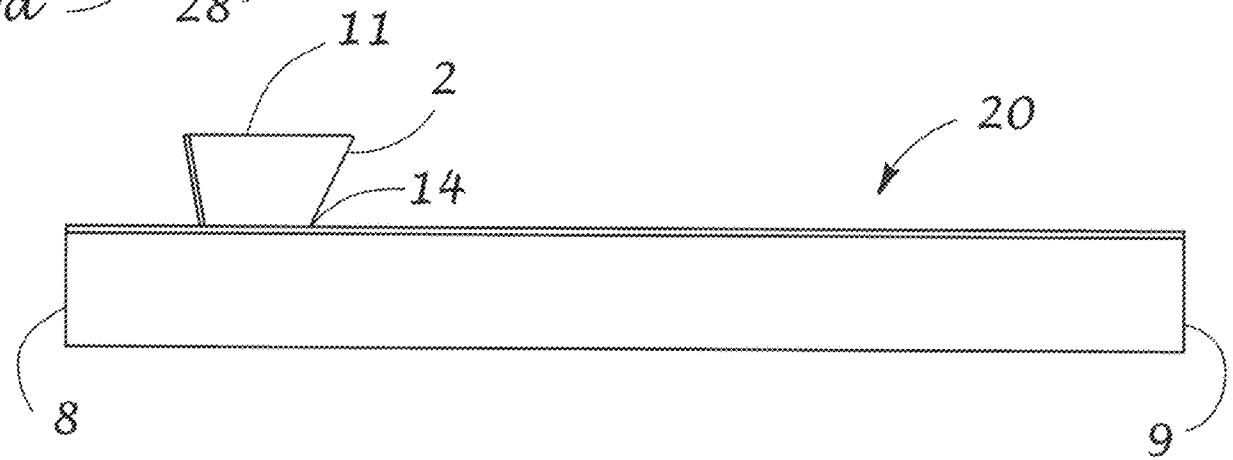
FIG. 4*a* is a side view of the assembled pipe.
Figure 4B:
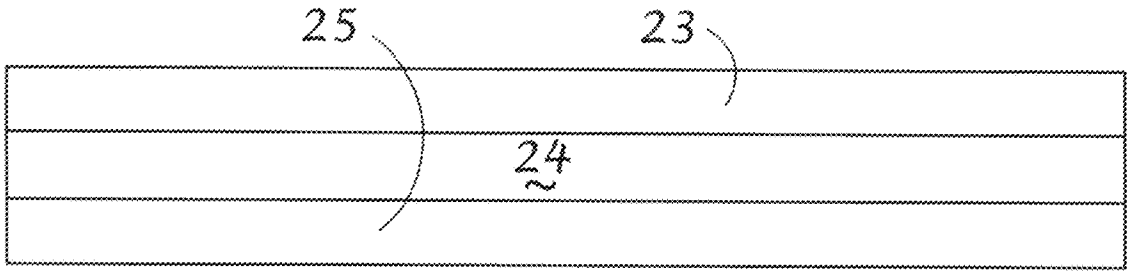
FIG. 4*b* is a bottom view of the assembled pipe.
Figure 5B:
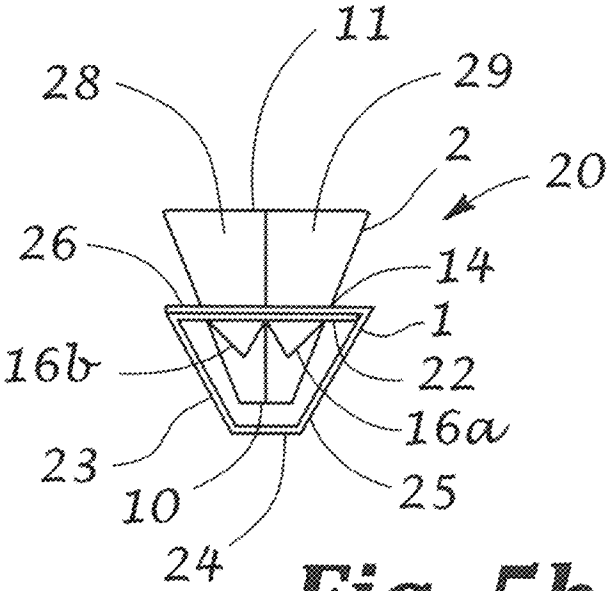
FIG. 5*b* is an end view from the opposite end of the aerator end of the assembled pipe taken from the opposite end of the bowl end.
Figure 5A:
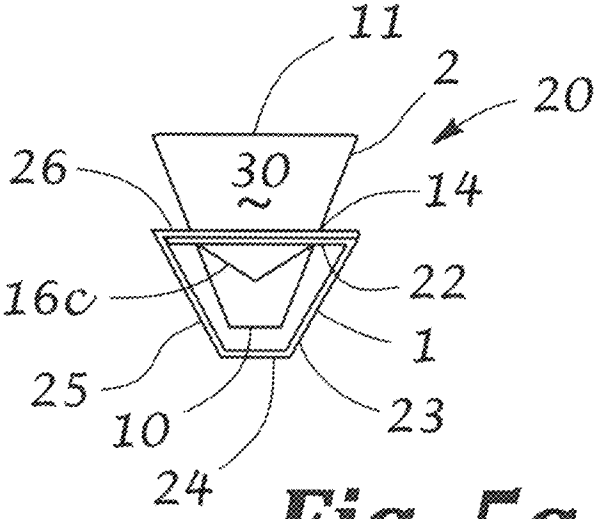
FIG. 5*a* is an end view from the aerator end of the assembled pipe taken from the bowl end.

The disposable pipe 20 is portable and inexpensive, and is used to smoke or burn a substance held in the bowl 2 of pipe 20.

The disposable pipe 20 is purchased unassembled. Prior to assembly, it is flat and about the size of a credit card.

The present invention, a disposable pipe 20, can be manufactured inexpensively from a substrate material such as a virgin cardboard blank 12, with a heat resistant foil 3 on one side of the cardboard blank 12. The foil 3 being on the inside portions of the pipe body 1 and the pipe bowl 2.

Figure 9:
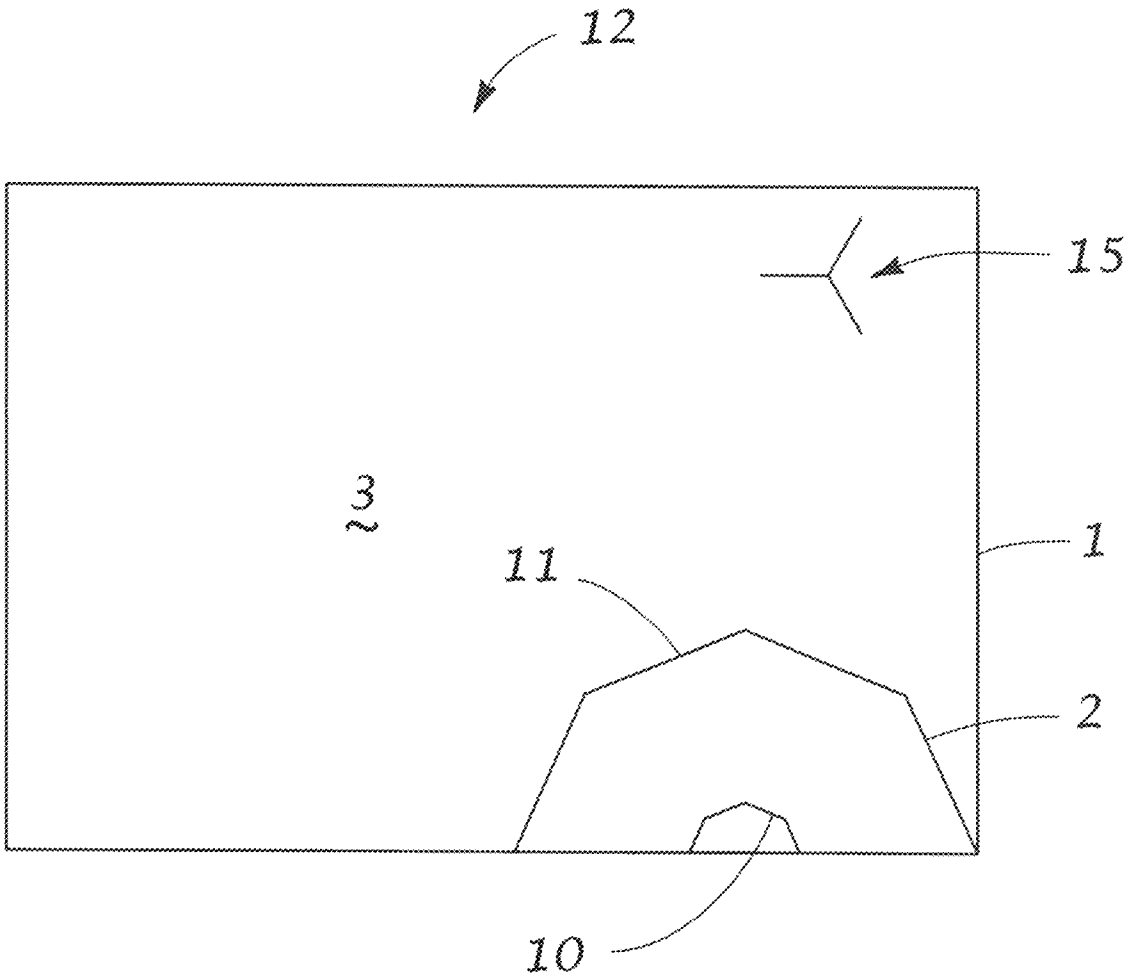
FIG. 9 is a bottom view of the unassembled pipe in a folded configuration for storage such as in a wallet.
Figure 10:
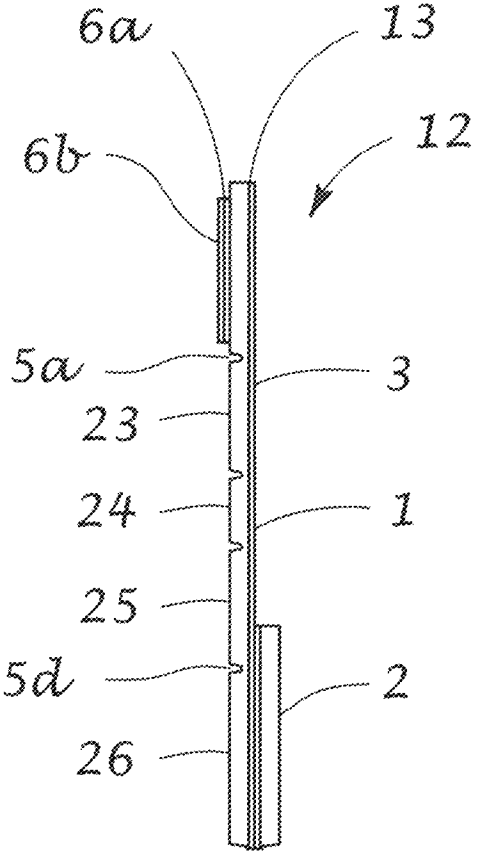
FIG. 10 is an end view of the unassembled pipe in the folded configuration.

Disposable pipe 20 is easily stored flat as shown in FIG. 9 until needed. The thickness of the unassembled pipe 20 being about the thickness of a credit card. If desired, several disposable pipes 20 can be stored one on top of the other and packaged in a preferred arrangement of for example five pipes 20 in a flat package (not shown). Therefore, unassembled pipe 20 can be carried in a wallet or purse at all times for convenience. When needed, a disposable pipe 20 can be assembled and ready to use in a short time, typically less than a minute. Disposable pipe 20 is designed for convenience, to be ready at any time, in any place, at a moment's notice.

Disposable pipe 20 is disposable and designed for a limited number of uses before it is discarded, since pipe 20 will degrade due to the heat from the burning of the substance being smoked. Pipe 20 is inexpensive to manufacture. The visible portions of the panels of disposable pipe 20 can be used as advertising space, for companies who want to promote products and/or services, similar to advertising on matchbooks as known in the art. Specifically, printing of advertisements can be made on any one or more of the panels 22, 23, 24, 25, 26, 27, 28, 29 and/or 30 in any combination.

a) The unassembled disposable pipe 20 is made of a cardboard or stiff paper stock blank 12 having two releasably attached portions, a body cardboard portion 12*a* and a bowl cardboard portion 12*b* in a single, thin cardboard blank 12 in a preferred embodiment that is approximately 3.4 inches long by 2.3 inches wide. The cardboard blank 12 and each of the body cardboard portion 12*a* and bowl cardboard portion 12*b* are laminated on one side with a heat resistant foil 3. The foil 3 is adhered to the cardboard blank 12 with a heat resistant adhesive strip 13. The cardboard blank 12, including body cardboard portion 12*a* and the bowl cardboard portion 12*b*, foil 3, adhesive 6*a* and adhesive 13 are of food quality. The body 1 is constructed from the body cardboard portion 12*a* which has five walled panels 22, 23, 24, 25 and 26, formed by four fold line scores 5*a*, 5*b*, 5*c*, and 5*d* along the axial length of body 1, to aid in folding and assembling disposable pipe 20. Body cardboard portion 12*a* is separated from bowl cardboard portion 12*b* along a die cut score line 31.

The body 1 also has a triangle shaped opening 14 cut into wall panel 26, in a preferred embodiment is 0.4 to 0.6 inches from the aerator end 8. Panel 22 has a corresponding pattern opening 15 made from three cuts 7*a*, 7*b* and 7*c* and three fold score lines 5*e*, 5*f* and 5*g* to create three flaps 16*a*, 16*b* and 16*c*. Panel 22 includes an adhesive strip 6*a* for attaching panel to panel 26. A removable liner 6*b* covers adhesive strip 6*a* until it is desired to attach panel 22 to panel 26, at which time liner 6*b* is removed. The flaps 16*a*, 16*b* and 16*c*, of wall panel 22, each with the adhesive 6*a*, are urged within longitudinal channel 4 when bowl 2 is inserted into body 1. These flaps securely hold and support bowl 2 in the body 1 upon assembly. Additionally, another embodiment, a plurality of flaps 16*a*, 16*b* and 16*c* and more flaps with the adhesive 6*a* can be made with characteristics of being formed by piercing the wall of body 1. Additionally, in another alternative embodiment four or more flaps with adhesive 6*a* can be formed with respective cuts 7*a*, 7*b* and 7*c* and more cuts in the panel 22.

The bowl 2 is a part of the flat cardboard blank 12. The bowl portion 12*b* of cardboard blank 12 is shaped like four sections of a semicircle, having four panels 27, 28, 29 and 30 formed with three fold score lines 35*a*, 35*b* and 35*c*, aligned radially, to aid in folding and assembling bowl 2. The bowl portion 12*b* is separated from cardboard blank 12 along cut score line 31.

To assemble the bowl 2, the user folds along each of the three scores 35*a*, 35*b* and 35*c*, with the foil 3 on the inside, then folds panel section 30 over panel 27, so that panel 30 is on panel 27 to create the bowl 2 in the shape of a frustum of a pyramid. The bowl 2 has a triangular top loading opening 11*a* on top 11. In a preferred embodiment the top loading opening 11*a* of bowl 2 measures 0.6 inches along each side of the equilateral triangle of the top 11. The triangular bottom suction side opening 10*a* of bowl 2 measures 0.1 inches along each side of the equilateral triangle of bottom 10. The triangular bottom suction side opening 10*a* at the bottom 10 of bowl 2 contains and prevents the substance to be smoked from falling through and out of bowl 2 into longitudinal channel 4 of body 1. Further the bowl 2 is larger at the top 11 and smaller at the bottom 10, tapered from the loading opening 11*a* to the suction side opening 10*a*. In the preferred embodiment, when bowl 2 is held in place in the opening 14, there is a clearance of 0.1 inches from the bottom 10 of bowl 2 to panel 24, placing the suction opening 10*a* centrally within the height H of the longitudinal channel 4, which allows air to freely flow through the bowl 2 into the pipe body 1 without obstruction. Where centrally within the height H of longitudinal channel 4 would place the suction side opening 10*a* within the longitudinal channel 4 with sufficient clearance from a wall of pipe body 1 to allow air to flow through bowl 2 and into body 1 without obstruction from a wall of pipe body 1.

To assemble the tube or pipe 1 from the cardboard blank 12, the user uses the pipe portion 12*a*, now separated from the bowl portion 12*b*. Alternatively if the pipe 1 portion is assembled first, the pipe portion 12*a* is separated from the bowl portion 12*b* at the cut line 31. Then the user folds the pipe portion 12*a* along each of the four scores 5*a*, 5*b*, 5*c* and 5*d*, with the foil 3 on the inside, and then folds panel 26 over the adhesive 6*a* on panel 22 after removal of the liner 6*b*. Pipe 1 is formed into an elongated tubular member having a substantially constant cross section along a longitudinal channel 4 extending between a first end 8 and a second open end 9. In the preferred embodiment pipe 1 is in a trapezoidal shaped elongated tube, that is 3.4 inches long, and open on both ends. However other cross sections may be formed such as square, rectangular or any other polygon shape for the elongated tube of pipe 1. The adhesive 6*a* is exposed by removal of a liner 6*b* to create a fixed structure. When panel 26 is aligned on panel 22, the triangular shaped opening 14 in panel 26 is aligned with the triangular shaped pattern opening 15 in panel 22. In a preferred embodiment each side of the equilateral triangle of the triangular shaped opening 14 measures 0.4 inches. Thus bowl will fit into opening 14 with a snug fit with the tapered shape of bowl 2 and the snug fit will be maintained by adhesive strip 6*a* between the sides of bowl 2 and the three flaps 16*a*, 16*b* and 16*c*. Further, this keeps the bottom 10 of bowl 2 from coming in contact with the lower panel 24 of pipe 2 so that there is continual air flow through bowl 2 into pipe 1.

The smaller diameter bottom 10 of bowl 2 is inserted into opening 14 in body 1, pushing flaps 16*a*, 16*b* and 16*c* down into longitudinal channel 4 of body 1, and tapered bowl 2 is held securely in place by adhesive 6*a* on flaps 16*a*, 16*b* and 16*c*.

Figure 11:
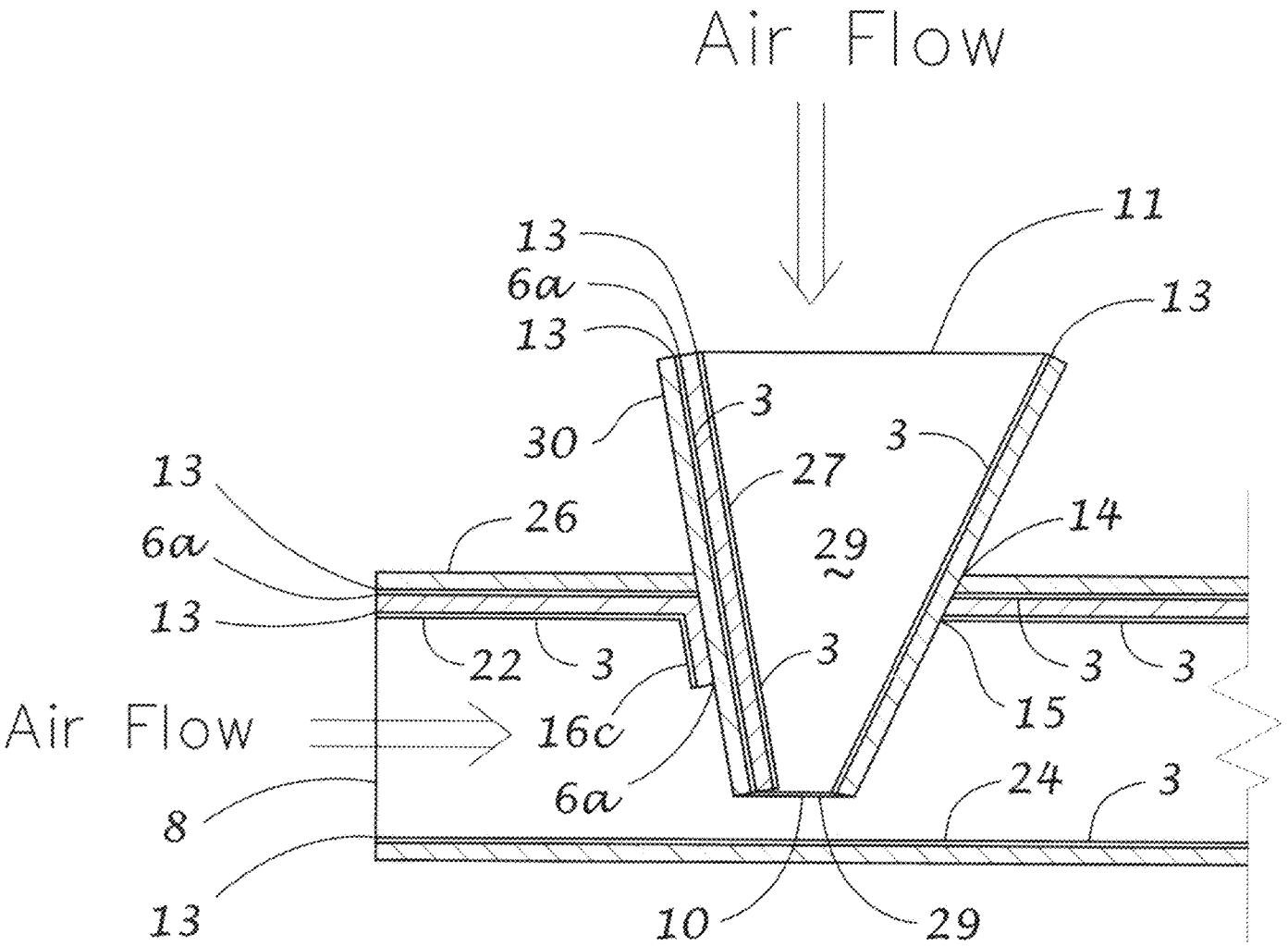
FIG. 11 is an enlarged sectional view of the bowl end of the assembled pipe taken along line B-B from FIG. 3 and similar to the view of FIG. 2.
Figure 12:
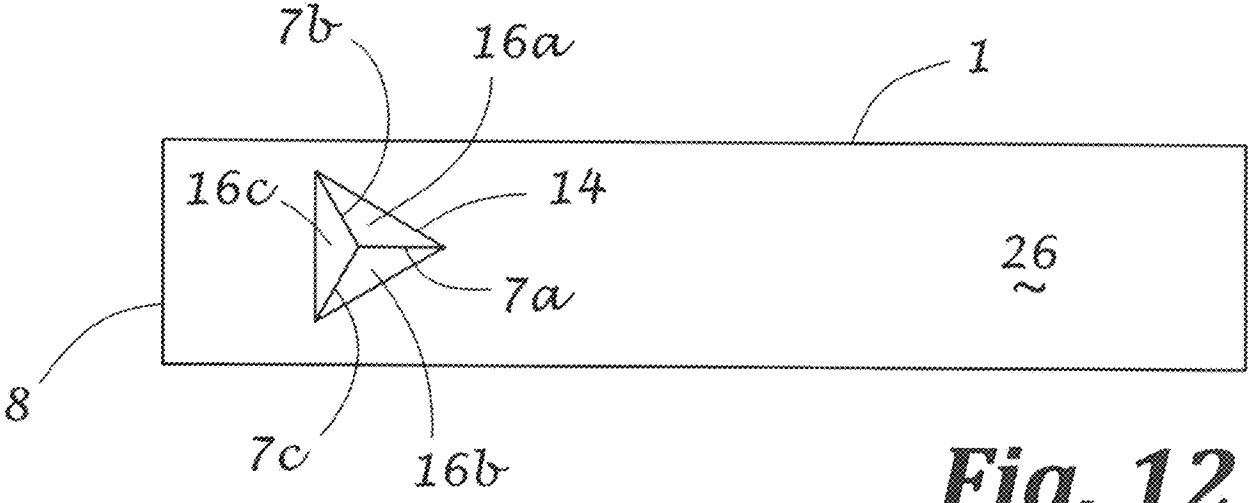
FIG. 12 is a plan view of the elongated body of the pipe.
Figure 13:
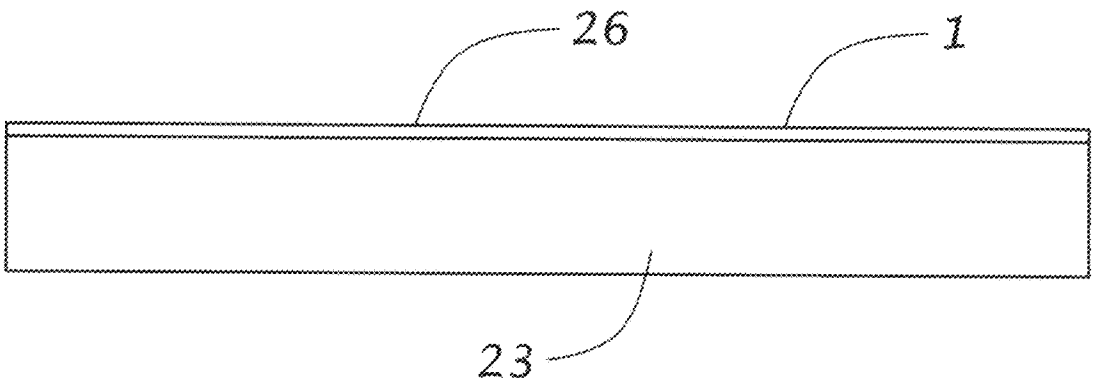
FIG. 13 is a side view of the elongated body of the pipe.
Figure 14:
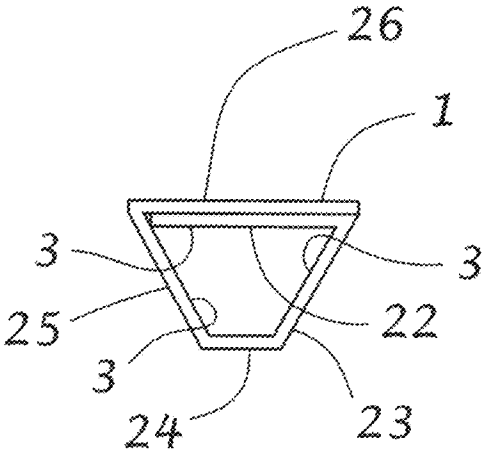
FIG. 14 is an end view of the elongated body of the pipe, from the aerator end.
Figure 15:
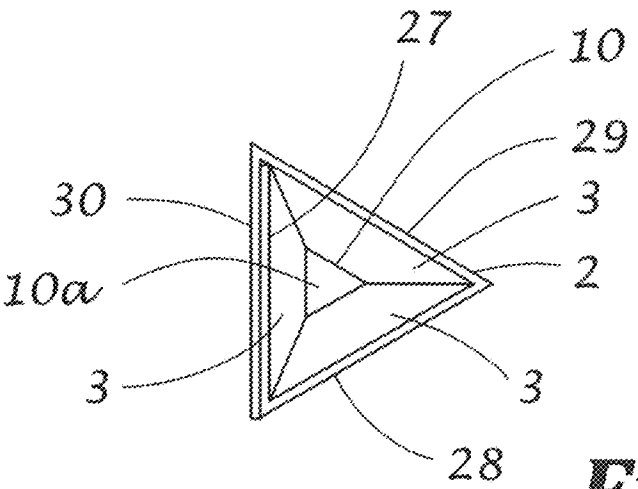
FIG. 15 is a top plan view of the pipe bowl.
Figure 16:
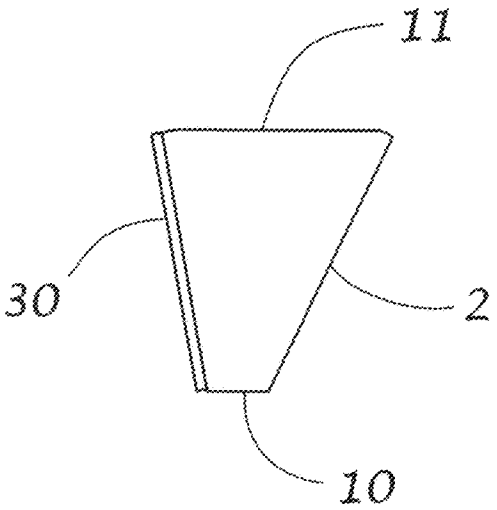
FIG. 16 is a side view of the pipe bowl.
Figure 17:
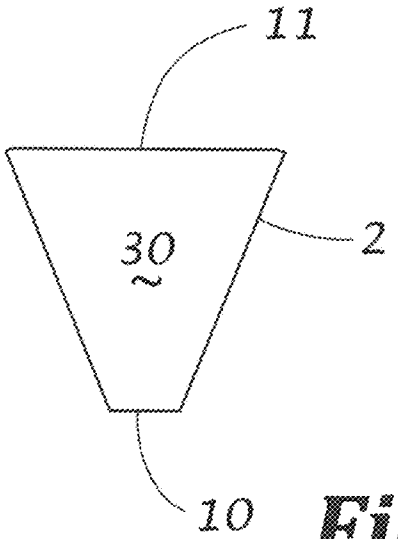
FIG. 17 is a front view of the pipe bowl.
Figure 18:
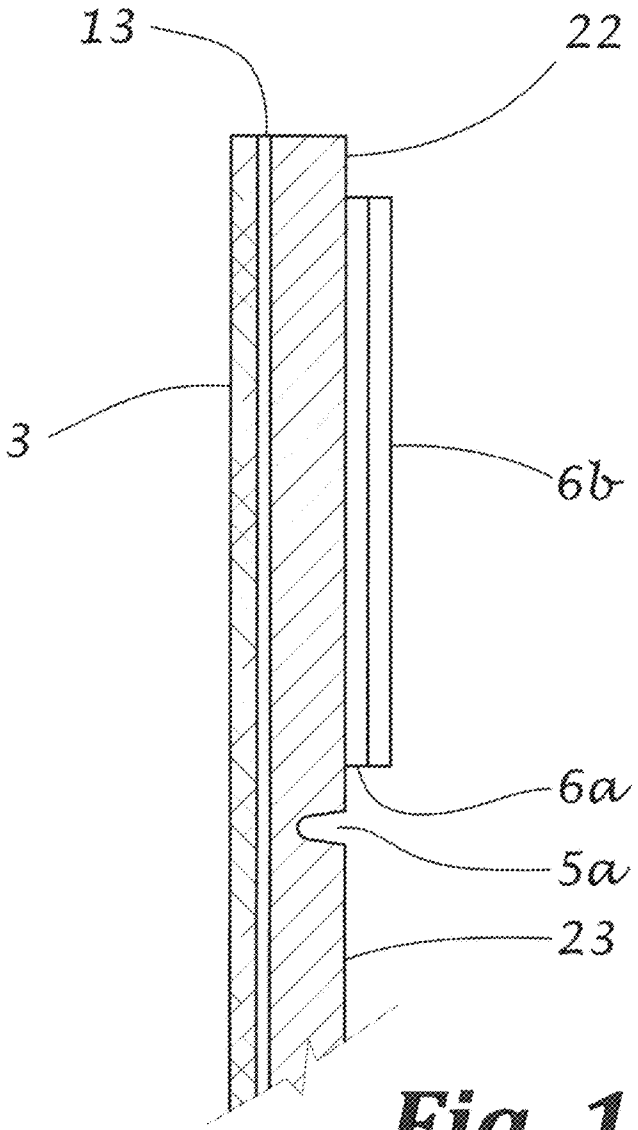
FIG. 18 is an enlarged cross-sectional view of panel 22 of the body cardboard portion similar to FIG. 7.

The disposable pipe (20) is now ready for use. To smoke, the user places the substance in bowl 2, holds a finger tightly against the carb opening or aerator end 8 of body 1, puts the bit end 9 of body 1 in mouth and ignites the substance to be smoked while inhaling air and smoke into mouth and if desired lungs. While the substance to be smoked is burning, the finger pressure over the aerator end 8 can be changed to adjust the volume and velocity of air and smoke inhaled into mouth and/or lungs. See FIG. 11 with diagrams of air flow.

The disposable pipe 20 can be used a limited number of times, perhaps a half-dozen bowls full of substance to be smoked, before it must be discarded, because of anticipated deterioration of the foil 3. A new disposable pipe 20 is then used.

As to the term standard size credit card as used herein, pursuant to the ISO (the International Organization for Standardization) and IEC (the International Electrotechnical Commission) ISO/IEC 7810:2003 the standard ID-1 provides a standard size for a credit card having the dimensions of 85.60×53.98 mm (3.370×2.125 in).

Figure 6:
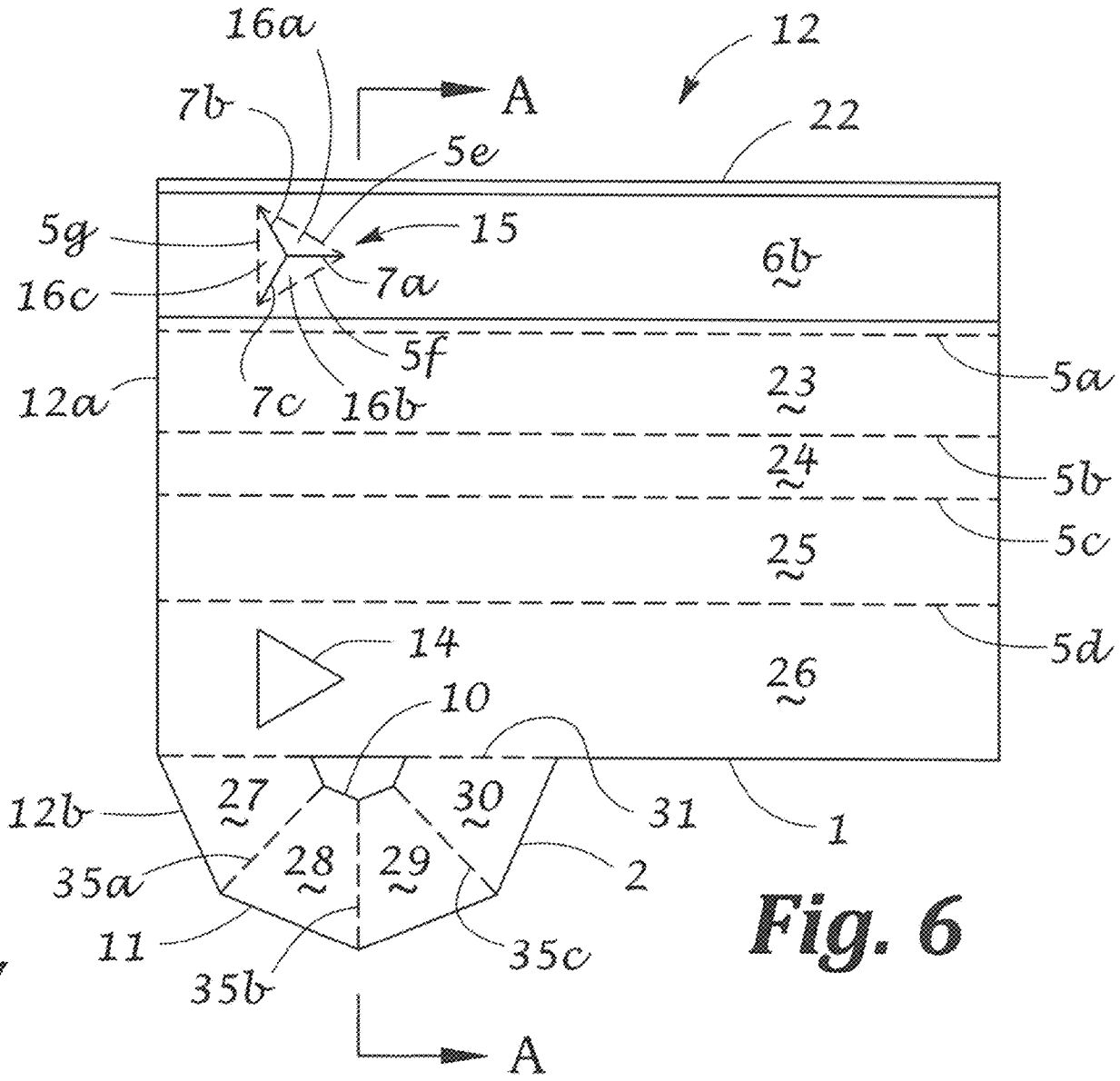
FIG. 6 is a top plan view of the outside of the unassembled pipe.
Figure 7:
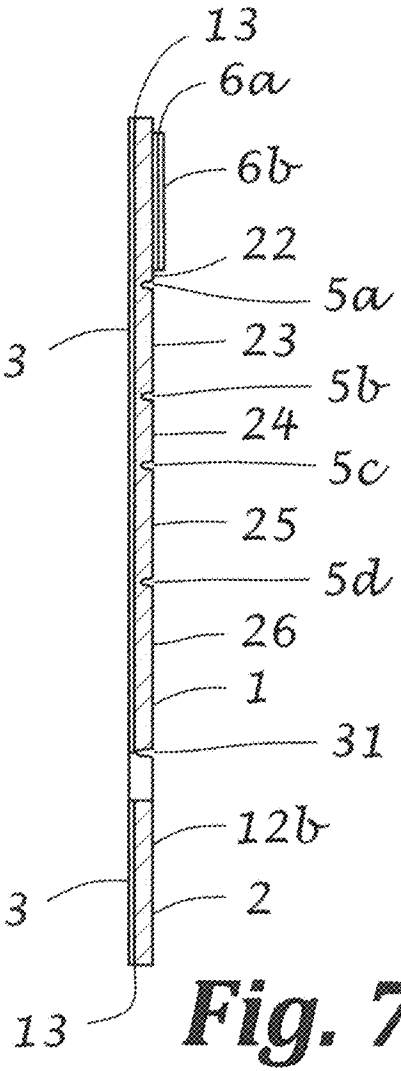
FIG. 7 is sectional view of the unassembled pipe taken along lines A-A of FIG. 6.
Figure 8:
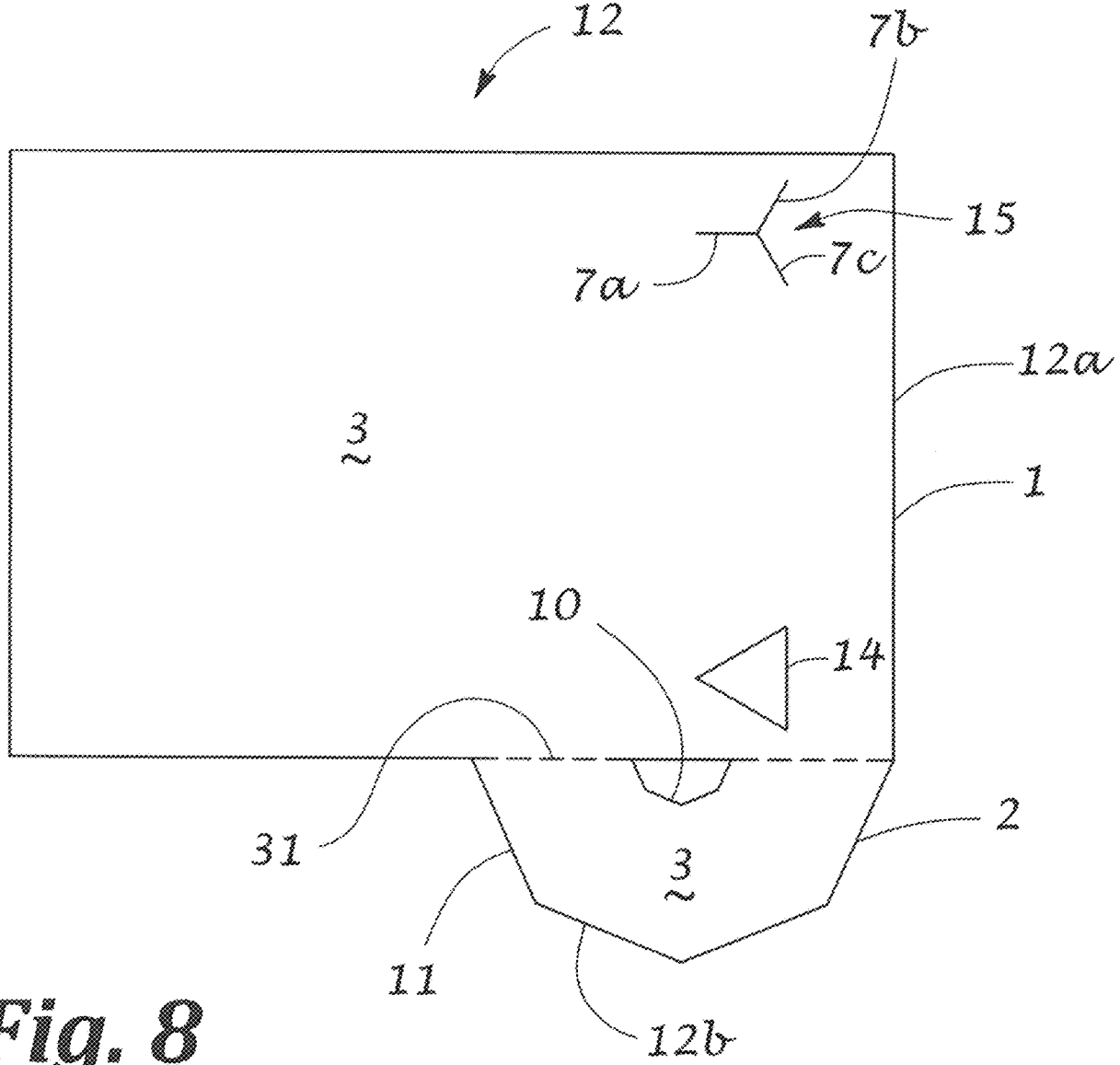
FIG. 8 is a bottom view of the inside of the unassembled pipe.
Figure 19:
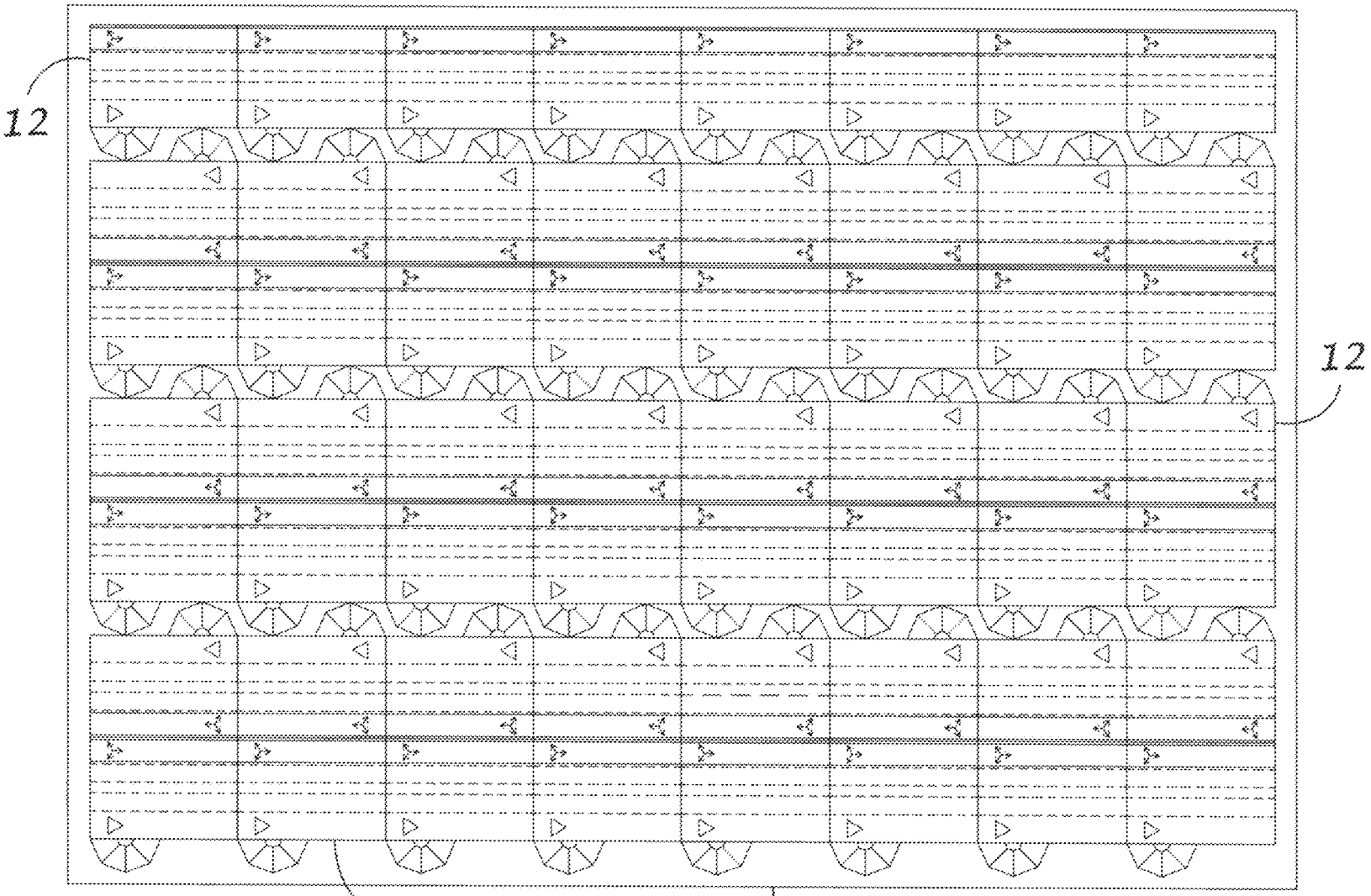
FIG. 19 is a plan view of a sheet of cardboard blanks 12 having seven rows of eight cardboard blanks 12.

Referring to FIG. 6, in a preferred embodiment, the length of the cardboard blank 12 is 3.4 inches and the width of the cardboard blank 12 is a total of 3.1 inches made up of the width of the body cardboard portion 12*a* being 2.3 inches and the width of the bowl cardboard portion 12*b* being 0.8 inches. The width of panel 26 is 0.6 inches, the height of pipe 20 from the bottom panel 24 to the top of bowl 2 is 0.6 inches. The master cardboard blank 50 as shown in FIG. 19 can be a preferred size of 20 inches by 28 inches. In this size, each cardboard blank for each smoking pipe 20 can be in a preferred size of 3.1 inches by 3.4 inches. In this size, fifty-six cardboard blanks can be arranged on the master cardboard blank 50 in seven rows of eight unassembled smoking pipes 20.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A smoking pipe comprising:

a tube having a longitudinal channel extending between a first end and a second open end opposite said first end, said tube being formed by a substrate;

said tube having a tube wall opening formed therein adjacent said first end, said tube wall opening having at least one flap extending around an edge of said opening, said at least one flap being directed into said longitudinal channel;

a bowl formed of said substrate, said bowl having an outer surface, an inner surface, a loading opening and a suction side opening, said bowl being disposed in said tube wall opening with said outer surface engaging said at least one flap for positioning said bowl in said tube wall opening with said suction side opening disposed centrally with respect to a height of said longitudinal channel.

2. The smoking pipe according to claim 1, further comprising an adhesive layer adhering said outer surface to said at least one flap.

3. The smoking pipe according to claim 1, wherein said bowl is in the shape of a frustum.

4. The smoking pipe according to claim 1, wherein said inner surface has a heat resistant foil laminated thereon.

5. The smoking pipe according to claim 1, wherein said substrate of said tube is scored around an edge of said tube wall opening for defining said at least one flap.

6. The smoking pipe according to claim 1, wherein said bowl has bowl panels defined by folds in said substrate.

7. The smoking pipe according to claim 6, wherein said at least one flap is divided into flap panels, each of said bowl panels engaging a respective one of said flap panels.

8. The smoking pipe according to claim 1, wherein said first end has a carb opening.

9. The smoking pipe according to claim 1, wherein said substrate is cardboard with a heat resistant foil on one side of said cardboard.

10. The smoking pipe according to claim 9, wherein said heat resistant foil is on an inside of said tube and on said inner surface of said bowl.

11. The smoking pipe according to claim 1, wherein said tube has a flat panel extending between said first end and said second open end, said tube wall opening is formed in said flat panel.

12. A smoking pipe comprising:

a tube having a longitudinal channel extending between a first end and a second open end opposite said first end, said tube being formed by a substrate, said tube having overlapping panels defining one side of said tube;

said tube having a tube wall opening formed in said one side adjacent said first end, said tube wall opening having at least one flap extending around an edge of said opening, said at least one flap being a portion of an interior panel of said overlapping panels directed into said longitudinal channel;

a bowl formed of said substrate, said bowl having an outer surface, an inner surface, a loading opening and a suction side opening, said bowl being disposed in said tube wall opening with said outer surface engaging said at least one flap for positioning said bowl in said tube wall opening with said suction side opening disposed centrally with respect to a height of said longitudinal channel.

13. A smoking pipe comprising:

a tube having a longitudinal channel extending between a first end and a second open end opposite said first end, said tube being formed by a substrate;

said tube having a tube wall opening formed therein adjacent said first end, said tube wall opening having at least one flap extending around an edge of said opening, said at least one flap being directed into said longitudinal channel;

a bowl formed of said substrate, said bowl having an outer surface, an inner surface, a loading opening and a suction side opening, said bowl being disposed in said tube wall opening with said outer surface engaged with said at least one flap with said suction side opening disposed centrally with respect to a height of said longitudinal channel.

* * * * *